US011401100B2

(12) United States Patent
Vogt et al.

(10) Patent No.: US 11,401,100 B2
(45) Date of Patent: Aug. 2, 2022

(54) CONTAINER WITH SCALABLE FEATURES

(71) Applicant: Graphic Packaging International, LLC, Atlanta, GA (US)

(72) Inventors: James Vogt, West Bend, WI (US); Jozef Milewski, Richfield, WI (US); Mark Baldwin, Milwaukee, WI (US); Kyle Baird, Milwaukee, WI (US)

(73) Assignee: Graphic Packaging International, LLC, Atlanta, GA (US)

( * ) Notice: Subject to any disclaimer, the term of this patent is extended or adjusted under 35 U.S.C. 154(b) by 399 days.

(21) Appl. No.: 16/382,265

(22) Filed: Apr. 12, 2019

(65) Prior Publication Data

US 2019/0315556 A1 Oct. 17, 2019

Related U.S. Application Data

(60) Provisional application No. 62/794,131, filed on Jan. 18, 2019, provisional application No. 62/674,834, (Continued)

(51) Int. Cl.

| | |
|---|---|
| ***B65D 81/38*** | (2006.01) |
| ***B65D 3/14*** | (2006.01) |
| ***B65D 3/06*** | (2006.01) |
| ***B65D 21/02*** | (2006.01) |
| ***B65D 21/08*** | (2006.01) |

(52) U.S. Cl.

CPC ..... *B65D 81/3869* (2013.01); *B65D 3/06* (2013.01); *B65D 3/14* (2013.01); *B65D 21/0233* (2013.01); *B65D 21/08* (2013.01)

(58) Field of Classification Search

CPC ..... B65D 81/3869; B65D 3/06; B65D 3/14; B65D 21/08; B65D 21/0233; B65D 3/22; B65D 1/265

See application file for complete search history.

(56) References Cited

U.S. PATENT DOCUMENTS 21,955 A * 11/1858 Grosholz ..... B65D 1/265 220/8
1,771,765 A 7/1930 Benson
(Continued)

FOREIGN PATENT DOCUMENTS

CA 2814820 11/2013
DE 42 2 6313 2/1994
(Continued)

OTHER PUBLICATIONS

International Search Report and Written Opinion for US/PCT/2019/027117 dated Jul. 29, 2019.
(Continued)

*Primary Examiner* — Shawn M Braden
(74) *Attorney, Agent, or Firm* — Womble Bond Dickinson (US) LLP

(57) ABSTRACT

A container for containing a fluid. The container includes a sidewall construct that includes an inner sidewall extending at least partially around an interior of the container and having an inner lower edge, and an outer sleeve attached to the inner sidewall, the outer sleeve has an outer lower edge that is spaced below the inner lower edge. The container also includes a closed bottom defining a bottom of the interior of the container.

30 Claims, 7 Drawing Sheets

Related U.S. Application Data filed on May 22, 2018, provisional application No. 62/657,246, filed on Apr. 13, 2018.

(56) References Cited

U.S. PATENT DOCUMENTS

| | | | | |
|---|---|---|---|---|
| 2,266,828 | A | 12/1941 | Sykes | |
| 2,675,954 | A | 4/1954 | Vogel | |
| 3,079,027 | A | 2/1963 | Edwards | |
| 3,082,900 | A | 3/1963 | Goodman | |
| 3,169,689 | A | 2/1965 | Schwartz | |
| 3,208,631 | A | 9/1965 | Edwards | |
| 3,456,860 | A | 7/1969 | Janninck | |
| 3,526,316 | A | 9/1970 | Kalogris | |
| 3,580,468 | A | 5/1971 | McDevitt | |
| 3,675,954 | A | 7/1972 | Konig | |
| 4,007,670 | A | 2/1977 | Albano et al. | |
| 4,049,122 | A | 9/1977 | Maxwell | |
| 4,231,476 | A | 11/1980 | Compton et al. | |
| 4,261,501 | A | 4/1981 | Watkins et al. | |
| 4,435,344 | A | 3/1984 | Iioka | |
| 5,145,107 | A | 9/1992 | Silver et al. | |
| 5,205,473 | A | 4/1993 | Coffin, Sr. | |
| 5,226,585 | A | 7/1993 | Varano | |
| 5,326,019 | A | 7/1994 | Wolff | |
| 5,425,497 | A | 6/1995 | Sorensen | |
| 5,460,323 | A | 10/1995 | Titus | |
| 5,469,983 | A | 11/1995 | Yawata | |
| 5,524,817 | A | 6/1996 | Meier et al. | |
| 5,542,599 | A | 8/1996 | Sobol | |
| 5,547,124 | A | 8/1996 | Mueller | |
| 5,628,453 | A | 5/1997 | MacLaughlin | |
| 5,667,135 | A | 9/1997 | Schaefer | |
| 5,685,480 | A | 11/1997 | Choi | |
| 5,697,550 | A | 12/1997 | Varano et al. | |
| 5,713,512 | A | 2/1998 | Barrett | |
| 5,746,372 | A | 5/1998 | Spence | |
| 5,752,653 | A | 5/1998 | Razzaghi | |
| 5,769,311 | A | 6/1998 | Morita et al. | |
| 5,772,111 | A | 6/1998 | Kirsch | |
| 5,775,577 | A | 7/1998 | Titus | |
| 5,794,843 | A | 8/1998 | Sanchez | |
| 5,826,786 | A | 10/1998 | Dickert | |
| 5,839,653 | A | 11/1998 | Zadravetz | |
| 5,842,633 | A | 12/1998 | Nurse | |
| 5,902,669 | A | 5/1999 | Steinhardt et al. | |
| 5,950,917 | A | 9/1999 | Smith | |
| 5,952,068 | A | 9/1999 | Neale | |
| 5,964,400 | A | 10/1999 | Varano et al. | |
| 5,975,336 | A | 11/1999 | Hart | |
| 6,068,182 | A | 5/2000 | Tokunaga | |
| 6,085,970 | A | 7/2000 | Sadlier | |
| 6,109,518 | A | 8/2000 | Mueller et al. | |
| 6,129,653 | A | 10/2000 | Fredricks et al. | |
| 6,152,363 | A | 11/2000 | Rule, Jr. | |
| 6,193,098 | B1 | 2/2001 | Mochizuki et al. | |
| 6,196,454 | B1 | 3/2001 | Sadlier | |
| 6,253,995 | B1 | 7/2001 | Blok et al. | |
| 6,265,040 | B1 | 7/2001 | Neale et al. | |
| 6,422,456 | B1 | 7/2002 | Sadlier | |
| 6,598,786 | B1 | 7/2003 | Guo | |
| 6,663,926 | B1 | 12/2003 | Okushita et al. | |
| 7,100,770 | B2 | 9/2006 | D'Amato | |
| 7,281,649 | B2 * | 10/2007 | Pyper, Jr. | B65D 3/14 229/5.5 |
| 7,717,325 | B2 | 5/2010 | Puls et al. | |
| 8,061,551 | B2 | 11/2011 | Matlovich | |
| 8,146,797 | B2 | 4/2012 | D'Amato | |
| 8,360,263 | B2 | 1/2013 | D'Amato | |
| 8,608,018 | B2 | 12/2013 | Babinsky et al. | |
| 9,102,461 | B2 | 8/2015 | Leser et al. | |
| 9,266,660 | B2 * | 2/2016 | Cai | B65D 3/14 |
| 9,290,312 | B2 * | 3/2016 | Brown | B65D 81/3874 |
| 9,648,969 | B2 | 5/2017 | Fu et al. | |
| 9,783,359 | B2 | 10/2017 | D'Amato | |
| 10,398,242 | B2 | 9/2019 | Booney et al. | |
| 2002/0000446 | A1 | 1/2002 | Taylor | |
| 2002/0179617 | A1 | 12/2002 | Barthlow et al. | |
| 2004/0112949 | A1 | 6/2004 | Hed et al. | |
| 2005/0029273 | A1 | 2/2005 | Hechmati | |
| 2005/0184137 | A1 * | 8/2005 | Dorsey | G10K 11/08 229/103 |
| 2005/0236468 | A1 | 10/2005 | Sadlier | |
| 2006/0118608 | A1 * | 6/2006 | Stahlecker | B65D 81/3869 229/403 |
| 2007/0117702 | A1 | 5/2007 | Okushita et al. | |
| 2007/0284426 | A1 | 12/2007 | Lo | |
| 2008/0078824 | A1 | 4/2008 | Spriegel et al. | |
| 2008/0078825 | A1 | 4/2008 | Puls et al. | |
| 2008/0087715 | A1 | 4/2008 | Robertson et al. | |
| 2008/0121681 | A1 * | 5/2008 | Wiedmeyer | B65D 81/3874 229/403 |
| 2008/0156857 | A1 | 7/2008 | Johnston | |
| 2009/0321508 | A1 * | 12/2009 | Fu | B65D 81/3874 229/403 |
| 2010/0025414 | A1 | 2/2010 | Mansour et al. | |
| 2010/0044424 | A1 | 2/2010 | Van Handel | |
| 2010/0108693 | A1 | 5/2010 | Zhang et al. | |
| 2010/0108694 | A1 | 5/2010 | Sedlbauer et al. | |
| 2010/0187296 | A1 | 7/2010 | Puls et al. | |
| 2012/0097685 | A1 | 4/2012 | Babinsky et al. | |
| 2012/0199641 | A1 | 8/2012 | Hsieh | |
| 2012/0261427 | A1 | 10/2012 | Bates | |
| 2012/0318805 | A1 * | 12/2012 | Leser | B29C 66/12881 220/592.17 |
| 2013/0001286 | A1 * | 1/2013 | Stahlecker | B65D 3/22 229/400 |
| 2013/0001289 | A1 | 1/2013 | Tedford | |
| 2013/0303351 | A1 * | 11/2013 | Fu | B31B 50/88 493/54 |
| 2015/0048086 | A1 * | 2/2015 | Brown | B65D 81/3874 220/62.11 |
| 2015/0108146 | A1 * | 4/2015 | Jameson | B65D 81/3869 220/592.16 |
| 2017/0113831 | A1 | 4/2017 | Aubele et al. | |
| 2017/0326830 | A1 | 11/2017 | Fu et al. | |
| 2017/0340149 | A1 | 11/2017 | Morgan | |
| 2018/0016052 | A1 * | 1/2018 | Tomioka | B65D 3/22 |
| 2018/0263391 | A1 * | 9/2018 | Garza | B65D 81/3869 |
| 2018/0370666 | A1 | 12/2018 | Garza et al. | |

FOREIGN PATENT DOCUMENTS

| | | |
|---|---|---|
| DE | 198 40 841 | 3/2000 |
| EP | 1 227 042 | 4/2004 |
| EP | 1 227 043 | 6/2004 |
| EP | 1 830 056 | 9/2007 |
| EP | 1 031 514 | 10/2007 |
| EP | 2 848 554 A2 | 3/2015 |
| GB | 1 261 532 | 1/1972 |
| JP | 8-276927 | 10/1996 |
| JP | 2000-118521 | 4/2000 |
| JP | 2000-142834 | 5/2000 |
| JP | 2000-226022 | 8/2000 |
| WO | WO 94/03326 | 2/1994 |

OTHER PUBLICATIONS

International Search Report and Written Opinion for US/PCT/2019/027119 dated Jul. 29, 2019.

International Search Report and Written Opinion for US/PCT/2019/027120 dated Jul. 31, 2019.

Third-Party Submission Under 37 CFR 1.290 for U.S. Appl. No. 16/382,265 dated Apr. 14, 2020, including Concise Description of Relevance.

Supplementary European Search Report for EP 19 78 5215 dated Dec. 6, 2021.

* cited by examiner

CONTAINER WITH SCALABLE FEATURES

CROSS-REFERENCE TO RELATED APPLICATIONS

This application claims the benefit of each of U.S. Provisional Patent Application No. 62/657,246, filed on Apr. 13, 2018, U.S. Provisional Patent Application No. 62/674,834, filed on May 22, 2018, and U.S. Provisional Patent Application No. 62/794,131, filed on Jan. 18, 2019.

INCORPORATION BY REFERENCE

The disclosures of each of U.S. Provisional Patent Application No. 62/657,246, filed on Apr. 13, 2018, U.S. Provisional Patent Application No. 62/674,834, filed on May 22, 2018, and U.S. Provisional Patent Application No. 62/794,131, filed on Jan. 18, 2019, are hereby incorporated by reference for all purposes as if presented herein in their entirety.

BACKGROUND OF THE DISCLOSURE

The present disclosure generally relates to containers for containing fluid, for example, beverage containers. In one embodiment, the present disclosure relates to a container formed from a sidewall and having scalable features.

SUMMARY OF THE DISCLOSURE

According to one aspect of the disclosure, a container for containing a fluid comprises a sidewall construct and a closed bottom defining a bottom of the interior of the container. The sidewall construct comprises an inner sidewall extending at least partially around an interior of the container and having an inner lower edge, and an outer sleeve attached to the inner sidewall, the outer sleeve has an outer lower edge that is spaced below the inner lower edge.

According to another aspect of the disclosure, a method of forming a container for containing a fluid comprises obtaining an inner sidewall having an inner lower edge and an outer sleeve having an outer lower edge, and attaching the outer sleeve to the inner sidewall to form a sidewall construct having the outer lower edge spaced below the inner lower edge. The method further comprises forming an interior of the container by positioning the sidewall construct so that the inner sidewall extends at least partially around the interior, and positioning a closed bottom relative to the sidewall construct to define a bottom of the interior.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

Containers according to the present disclosure can accommodate fluids, e.g., beverages, of different sizes and compositions. For the purpose of illustration and not for the purpose of limiting the scope of the disclosure, the following detailed description describes a container for heated fluids, e.g., coffee or coffee-based products, tea, hot chocolate, cider, soup, etc. It will be understood that the containers described herein can hold cold beverages or room temperature beverages, and can hold at least partially solid food products, without departing from the disclosure.

In this specification, the terms "lower," "bottom," "upper," and "top" indicate orientations determined in relation to fully erected and upright containers. As described herein, containers can be formed from blanks by overlapping multiple portions, panels, and/or end flaps. Such portions, panels, and/or end flaps may be designated herein in terms relative to one another, e.g., "first", "second", "third", etc., in sequential or non-sequential reference, without departing from the disclosure.

Figure 1:
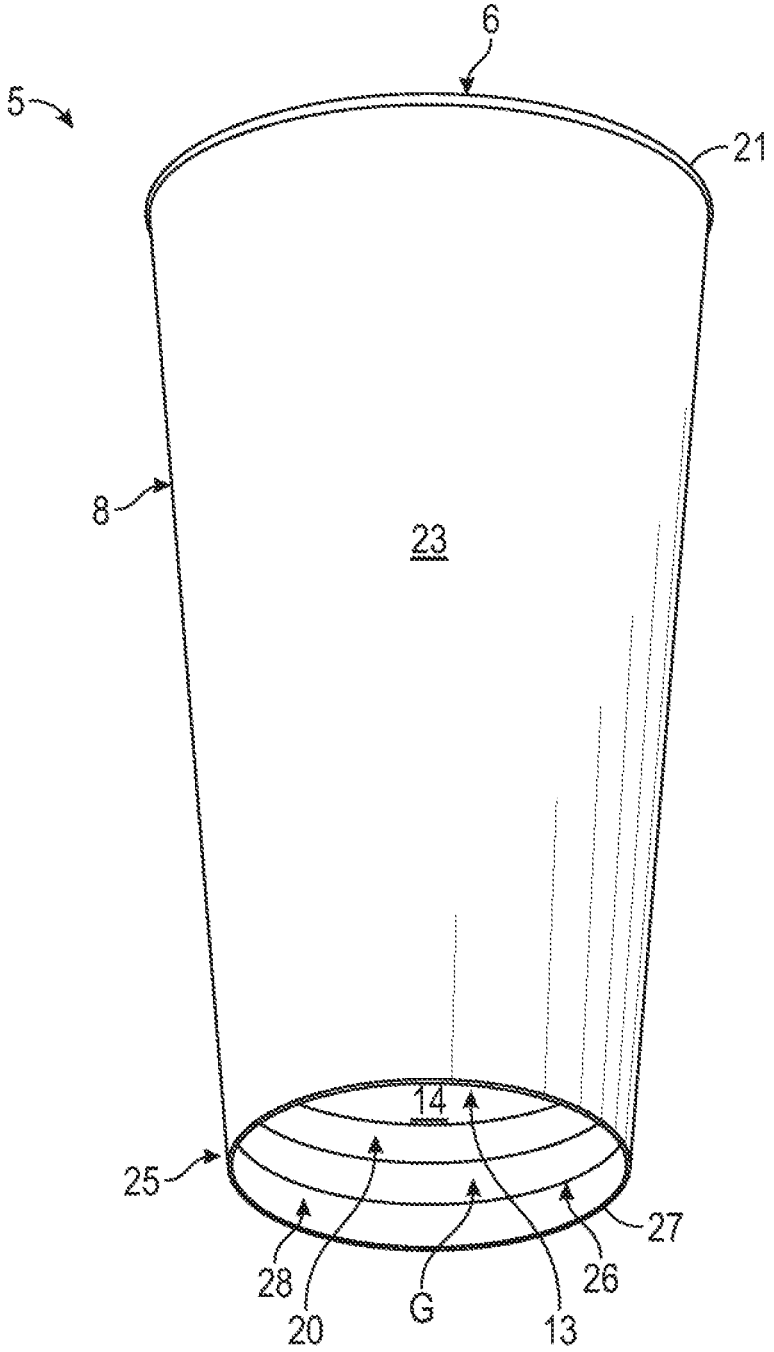
FIG. 1 is a perspective view of a container according to a first exemplary embodiment of the disclosure.
Figure 2:
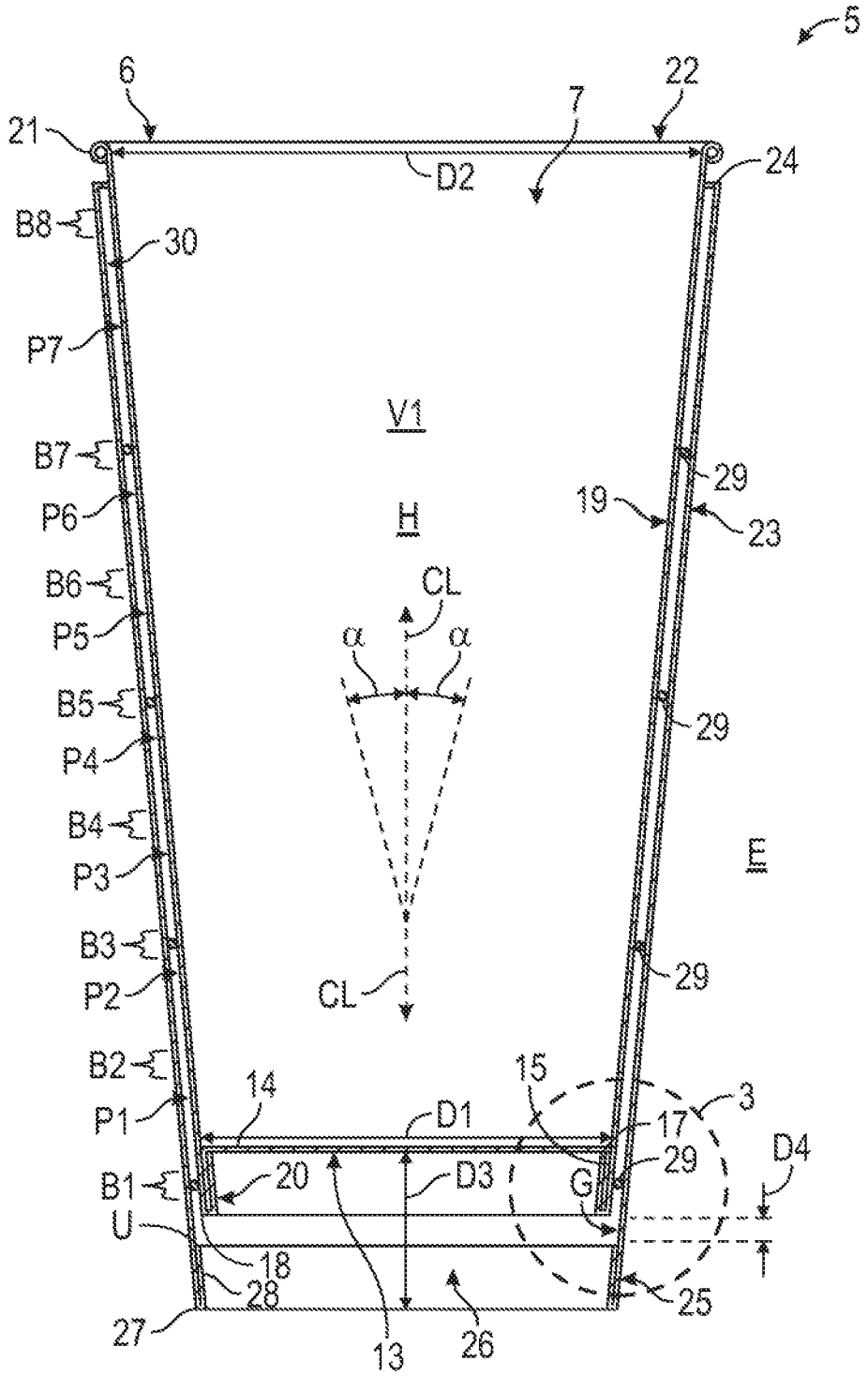
FIG. 2 is cross-sectional view of the container of FIG. 1.
Figure 3:
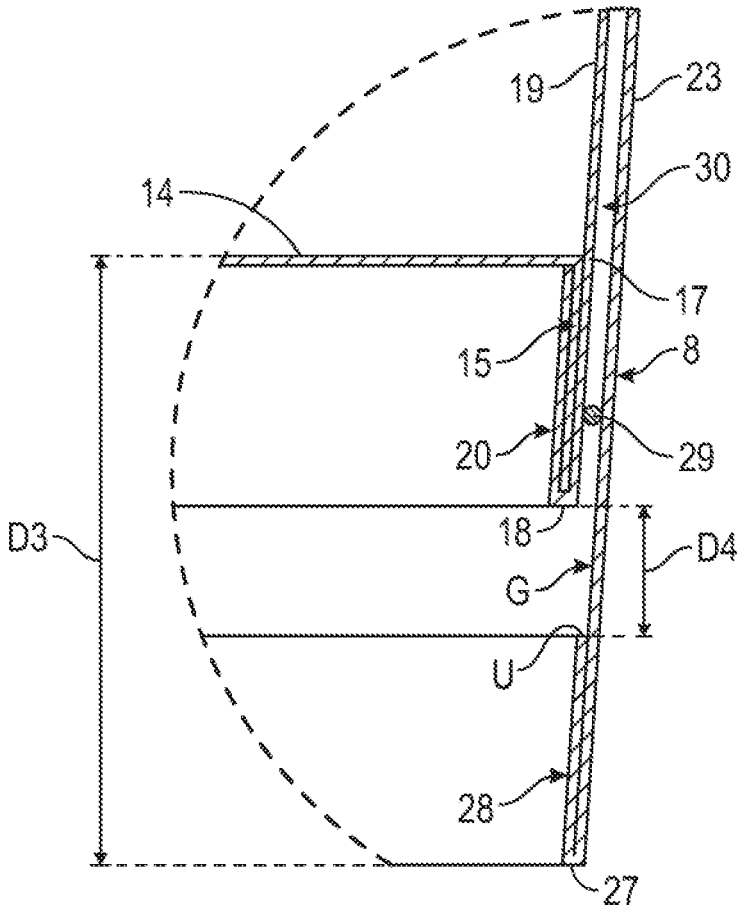
FIG. 3 is an enlarged view of the area 3 identified in FIG. 2.

FIG. 1 is a perspective view, and FIGS. 2 and 3 are cross-sectional views, of a container 5 according to a first exemplary embodiment of the disclosure. In one embodiment, the container 5 is a cup having the general shape of a truncated cone with an open top 6, a closed bottom 13, and a sidewall construct 8 extending from a bottom edge to a top edge of the container 5. The closed bottom 13 and the sidewall construct 8 define an interior space 7 (FIG. 2) of the container 5 with an interior volume V1 (broadly, "first interior volume") that is for holding a fluid such as a hot beverage, e.g., tea, coffee, cider, hot chocolate, etc.

Referring additionally to the cross-sectional views of FIGS. 2 and 3, the sidewall construct 8 comprises an annular inner sidewall 19 (broadly, "inner wall") and an outer sleeve 23 (broadly, "outer wall") attached to the inner sidewall 19 such that at least a portion of the sidewall construct 8 can be referred to as a double wall structure. The container 5 includes insulating features in the sidewall construct 8 that include radially adjacent spacers 29 separated by respective radial gaps 31. The spacers 29 can be at least partially formed from an adhesive, such as a hot melt glue or other glue, and extend from the inner sidewall 19 to the outer sleeve 23 to adhesively attach the outer sleeve 23 to the inner sidewall 19. Details of the insulating features of the container 5, including the arrangement of the spacers 29, are described in U.S. Provisional Patent Application No. 62/657,246, filed on Apr. 13, 2018, which is incorporated by reference herein in its entirety.

As discussed further below, the insulating features of the container 5 are arranged such that cost and materials savings can be realized, and so that an insulation profile of the container 5 can be enhanced, for example, so that the temperature of the fluid in the container 5 can be maintained within a selected or desired range of temperatures, and a customer can be provided with a more comfortable surface to grasp the container 5. As described herein, the sidewall construct 8, including at least the inner sidewall 19, the outer sleeve 23, and the accompanying insulating features, are scalable features such that a desired interior volume of the interior space 7 can be selected upon formation of the container 5. In one embodiment, the container 5 can be provided with fewer or without the insulating features described herein, e.g., so that only the coupled inner sidewall 19 and outer sleeve 23 are provided.

As shown, the bottom 13 of the container 5 includes a generally circular bottom panel 14 and an annular leg 15 foldably connected to and downwardly-depending from the bottom panel 14 at a generally circular line of weakening 17. The bottom panel 14 has a diameter D1 (FIG. 2) that generally corresponds to a horizontal distance from one point on the line of weakening 17 to an opposite point on the line of weakening 17, and can correspond to an inner diameter of the inner sidewall 19 at the bottom panel 14. The inner sidewall 19 extends upwardly from the closed bottom 13 to define the interior space 7 of the container 5. The inner sidewall 19 extends downwardly below the bottom panel 14 to define a lower edge margin 20, along a portion of which the annular leg 15 is adhesively attached to secure the bottom panel 14 to the inner sidewall 19 to form the bottom of the interior space 7 of the container 5.

As shown, the lower edge margin 20 of the inner sidewall 19 extends along the outer surface of the annular leg 15, wraps under a bottom edge or lower edge thereof, and extends upwardly along the interior surface of the annular leg 15 toward the bottom panel 14. The lower edge margin 20 of the inner sidewall 19 can be an at least partially flexible portion of the inner sidewall 19 configured to engage the annular leg 15, and can include surface features to facilitate such engagement, for example, an adhesive treatment and/or frictionally-enhancing patterning. As described herein, the portion of the lower edge margin 20 of the inner sidewall 19 overlying the lower edge of the annular leg 15 will define an inner bottom edge or inner lower edge 18 of the inner sidewall 19. In one embodiment, the lower edge of the annular leg 15 can define the lower edge of the coupled inner sidewall 19 and the bottom 13. The bottom 13 can be secured to the sidewall construct 8 in a different configuration without departing from the disclosure.

For example, in one embodiment, the bottom 13 can be received in the interior space 7 formed by the sidewall construct 8 and coupled thereto, e.g., in the manner described above. In another embodiment, the bottom 13 and the annular leg 15 of the container 5 can be integrally formed with the inner sidewall 19 or can be otherwise attached to a portion of the inner sidewall 19 by other attachment means. In still another embodiment, the bottom 13 can be coupled to the inner sidewall 19 as described above, and the coupled inner sidewall 19/bottom 13 can be inserted into or otherwise coupled with the sleeve 23, e.g., via the spacers 29. In yet another embodiment, the sidewall construct 8 can be formed in a flat configuration, and then wrapped around and coupled to the bottom 13 in the manner described above.

As also shown, a top edge of the inner sidewall 19 is curved or curled to define a top or upper rim 21 of the container 5 that circumscribes an opening 22 in communication with the interior space 7 of the container 5. The rim 21 has a diameter D2 and the rim 21 and/or an upper portion of the container 5 can be flanged or otherwise configured to engage a lid or other top container closure structure.

The illustrated configuration of the truncated conical shape of the container 5 can be achieved by forming the inner sidewall 19 from a flat blank by folding around a mandrel such that an overlapping seam is provided, and which can be secured, for example, with an adhesive such as glue. The generally truncated conical shape of the sleeve 23 can be formed in a similar manner, or can be formed through a different process without departing from the disclosure. The arrangement of the bottom panel 14 and the annular leg 15 of the closed bottom 13 of the container 5 can be formed, in one example, by providing a generally circular blank having an outer periphery that is downwardly folded to provide the annular leg 15 that intersects the bottom panel 14 at the line of weakening 17.

The inner sidewall 19 (and the sleeve 23 disposed thereareound), as shown, have a tapered configuration such that the inner sidewall 19 and the sleeve 23 extend at an oblique angle $\alpha$ relative to a vertical centerline CL of the container 5. It will be understood that the container 5 can have a different configuration and can be formed by other methods and mechanisms without departing from the disclosure.

Still referring to FIGS. 1, 2, and 3, the outer sleeve or sleeve 23, e.g., a wrap or other layer, is disposed in at least partial circumferential engagement with the inner sidewall 19 such that the sleeve 23 presents an outer surface of the container 5 for engagement by a user. For example, a user can wrap his or her fingers around a portion of the sleeve 23.

As shown, the sleeve 23 includes an upper edge 24 proximate the rim 21 and the sleeve 23 protrudes downwardly past the inner sidewall 19 such that a lower portion of the sleeve 23 forms an annular base 25 of the container 5 that defines an interior annular recess 26 between an outer bottom edge or outer lower edge 27 of the outer sleeve 23/container 5 and the bottom panel 14. A lower edge margin 28 of the sleeve 23, as shown, is interiorly folded into face-to-face contact with a lower portion of the inner sidewall 19/annular base 25 to define the lower edge 27 and to provide a two-ply structure at a bottom portion of the annular base 25 upon which the container 5 can rest in an upright orientation. In this regard, the lower edge 18 of the inner sidewall 19 is spaced above the lower edge 27 of the outer sleeve 23. In one embodiment, the lower edge 18 of the inner sidewall 19 can be vertically aligned with the lower edge 27 of the outer sleeve 23.

As shown, the bottom panel 14 is positioned a selected vertical distance D3 (broadly, "first vertical distance") above the lower edge 27 of the container 5, and an annular discontinuity or annular gap G is defined between the lower edge 18 of the inner sidewall 19 and a top edge or upper edge U of the lower edge margin 28 of the sleeve 23, with the gap G having a vertical distance D4 along the sleeve 23. As described further herein, the gap G can provide a fluid vent or pathway to facilitate insulation and venting of the insulating features between the inner sidewall 19 and the sleeve 23 of the container 5.

As described herein, at least the interface between the sleeve 23 and the inner sidewall 19 of the container 5 forms insulating features of the container 5 that include a cavity 30 defined between the inner wall 19 and the outer sleeve 23. In one embodiment, the insulating features of the container 5 can also include one or more portions of the inner sidewall 19 and/or the sleeve 23. Insulating features of the container 5 are further described in U.S. Provisional Patent Application No. 62/657,246, filed on Apr. 13, 2018, the entire contents of which are incorporated by reference herein.

Figure 4:
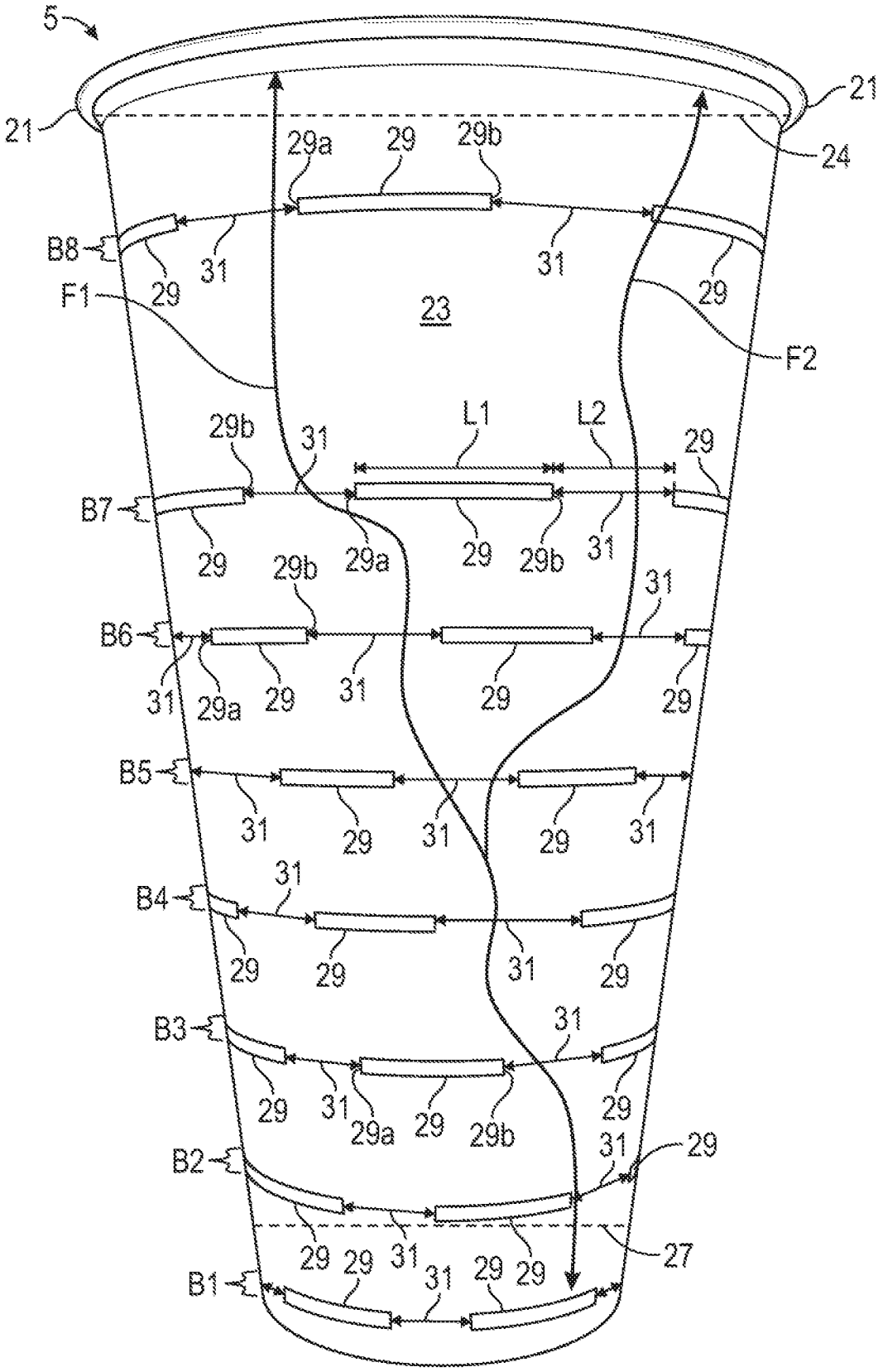
FIG. 4 is a front view of the container of FIG. 1 with an outer sleeve removed.

Referring additionally to FIG. 4, a front view of the container 5 with the sleeve 23 removed is illustrated, e.g., such that the inner sidewall 19 is visible. As shown, a plurality of annular bands B1, B2, B3, B4, B5, B6, B7, and B8 of adhesive are applied between the inner sidewall 19 and the outer sleeve 23 to attach the outer sleeve 23 to the inner sidewall 19. One or more of the annular bands B1, B2, B3, B4, B5, B6, B7, and B8 can be a discontinuous pattern of adhesive or other material such that one or more of the bands B1, B2, B3, B4, B5, B6, B7, and B8 comprise adhesive that form the spacers 29 that extend from the inner sidewall to the outer sleeve 23, and the gaps 31 that are radially spaced between adjacent spacers 29 along the circumferential length of each of the bands B1, B2, B3, B4, B5, B6, B7, and B8 around the inner sidewall 19. In one embodiment, the gaps 31 can be voids, interruptions, or discontinuities of the material that forms the spacers 29 along the bands B1, B2, B3, B4, B5, B6, B7, and B8. In one embodiment, one or more of the bands B1, B2, B3, B4, B5, B6, B7, and B8 can comprise a continuous length of material that circumscribes the respective band to form a spacer. It will be understood that a different numbers of bands of spacers 29 can be present without departing from the disclosure.

As shown, the spacers 29 have a length L1 corresponding to the length of the respective arc around the circumference of the portion of the inner sidewall 19 corresponding to the location of the spacer 29, with the length L1 extending between respective first and second ends 29*a*, 29*b* of a respective spacer 29. Similarly, the gaps 31 have a length L2 corresponding to the length of the arc around the circumference of the portion of the inner sidewall 19 corresponding to the location of the gap 31 that is a portion of the corresponding respective band B1 through B7 that is devoid of material, with the length L2 extending from an adjacent second end 29*b* to a first end 29*a* of adjacent spacers 29. In this regard, the lengths L2 of the respective gaps 31 correspond to an amount of savings of the material of the spacers 29, for example, compared to a similar band that comprises a continuous spacer 29, e.g., such that no gaps 31 are present.

Still referring to FIGS. 1-4, the spacers 29 and the gaps 31 of the bands B1, B2, B3, B4, B5, B6, B7, and B8 are arranged along the inner sidewall 19 such that a plurality of fluid pathways F1, F2 are presented around the spacers 29 and through respective gaps 31 between a top edge or upper edge 24 of the sleeve 23 and the lower edge 18 of the inner sidewall 19 (see FIG. 2). While two fluid pathways F1, F2 are illustrated, the configuration of the annular bands B1, B2, B3, B4, B5, B6, B7, and B8 provide much more than two possible fluid pathways.

As shown, a pocket P1 is formed in the cavity 30 between the inner sidewall 19 and the sleeve 23 between the band B1 and the band B2, a pocket P2 is formed in the cavity 30 between the inner sidewall 19 and the sleeve 23 between the band B2 and the band B3, a pocket P3 is formed in the cavity 30 between the inner sidewall 19 and the sleeve 23 between the band B3 and the band B4, a pocket P4 is formed in the cavity 30 between the inner sidewall 19 and the sleeve 23 between the band B4 and the band B5, a pocket P5 is formed in the cavity 30 between the inner sidewall 19 and the sleeve 23 between the band B5 and the band B6, a pocket P6 is formed in the cavity 30 between the inner sidewall 19 and the sleeve 23 between the band B6 and the band B7, and a pocket P7 is formed in the cavity 30 between the inner sidewall 19 and the sleeve 23 between the band B7 and the band B8. At least the pockets P1, P2, P3, P4, P5, P6, P7 provide insulating gaps or spaces between the inner sidewall 19 and the sleeve 23. In one embodiment, each pocket P1, P2, P3, P4, P5, P6, P7 can have a width measured from the inner sidewall 19 to the sleeve 23 and at least partially determined by the size of the spacers 29, which can also have the width W, for example, between about 30 mils to about 40 mils. The arrangement of the spacers 29 and the gaps 31 along the inner sidewall 19 is such that the gaps 31 provide for fluid communication/air flow between the pockets P1, P2, P3, P4, P5, P6, P7 at various locations along the container 5. In one embodiment, the fluid pathways F1, F2 comprise respective pockets P1, P2, P3, P4, P5, P6, P7.

In this regard, the arrangement of the spacers 29 and the gaps 31 of the annular bands B1, B2, B3, B4, B5, B6, B7, B8 provides the one or more fluid pathways F1, F2. The disclosed arrangement of these insulating features is such that heat H generated by a fluid in the interior space 7 of the container 5 can transfer, for example, through conduction, convection, and/or radiation, through the inner sidewall 19 and/or spacers 29 into one or more of the pockets P1, P2, P3, P4, P5, P6, and can be released into the external environment or atmosphere E via the one or more fluid pathways F1, F2. In this regard, the fluid pathways F1, F2 can exit and/or extend into the gap G in the interior annular recess 26 at the bottom of the container 5, for example, so that heat H can escape into or through the interior annular recess 26, as well as past the upper edge 24 of the sleeve 23. Such insulating features can maintain the temperature or a desired temperature range of the fluid in the container 5 by resisting the heat transfer from the cavity 30 to the external environment E to facilitate grasping by a user.

Further, in one embodiment, the surface temperature of the sleeve 23 can be higher at points along the sleeve 23 that are aligned with the spacers 29, for example, due to thermal conduction of heat H through the solid material of the spacers 29, i.e., such that the spacers 29 are formed of a thermally-conductive material. Accordingly, regions of the sleeve 23 aligned with the gaps 31 and/or the pockets P1, P2, P3, P4, P5, P6, P7 present surfaces of lower temperature at which a user can grasp the sleeve 23, for example, by shifting the placement of his or her fingers along the sleeve 23 to provide for more comfortable use of the container 5. In one embodiment, the configuration of the bands B1, B2, B3, B4, B5, B6, B7, and B8 that create the tortious pathways F1, F2 help create resistance to air flow from the cavity 30 between the inner sidewall 19 and the outer sleeve 23, to the environment E outside the cavity 30 which helps maintain a desired temperature range for the beverage in the container 5 by reducing the amount of heat transfer from the cavity 30 to the external environment E. Furthermore, the arrangement of the spacers 29 and the gaps 31 of the annular bands B1, B2, B3, B4, B5, B6, B7, and B8 can result in a desired rigidity of the container 5 such that an optimal pattern of flexion is provided to the container 5 during use. In this regard, the dimensioning and arrangement of the spacers 29 and the gaps 31 can be selected to provide a desired thermal profile along the outer surface of the sleeve 23 when the container 5 is filled with a hot fluid such as tea, coffee, etc.

In one embodiment, the inner sidewall 19 and the sleeve 23, with insulating features therebetween, can be separately formed from the closed bottom 13, and so that the bottom 13 can be coupled to the sidewall construct 8 to form the container 5. In this regard, the sidewall construct 8 can receive the bottom 13 so that the bottom 13 can be selectively coupled at different vertical locations of the inner sidewall 19 to provide an interior space of the container 5 with different selected interior volumes. For example, if the distance D3 between the bottom panel 14 and the lower edge 27 of the container 5 were to be increased, the volume V1 of the interior space 7 would be reduced. Accordingly, the sidewall construct 8 provides the inner sidewall 19 as a uniform base or template to which the bottom 13 can be coupled at a desired distance D3 from the lower edge 27 to provide the container 5 with an interior space 7 of a desired volume. Such a modular configuration of the sidewall construct 8 can produce containers 5 having a uniform outer sleeve 23 but with interior spaces 7 of different volumes, e.g., corresponding to different retail sizes of beverages (hereafter, "different fluid sizes"). For example, the volume V1 can be about 4 oz, about 6 oz, about 8 oz, about 12 oz, about 16 oz, about 20 oz, or other integer or non-integer numbers therebetween. The container 5 can be provided with a different interior volume without departing from the disclosure.

Figure 5:
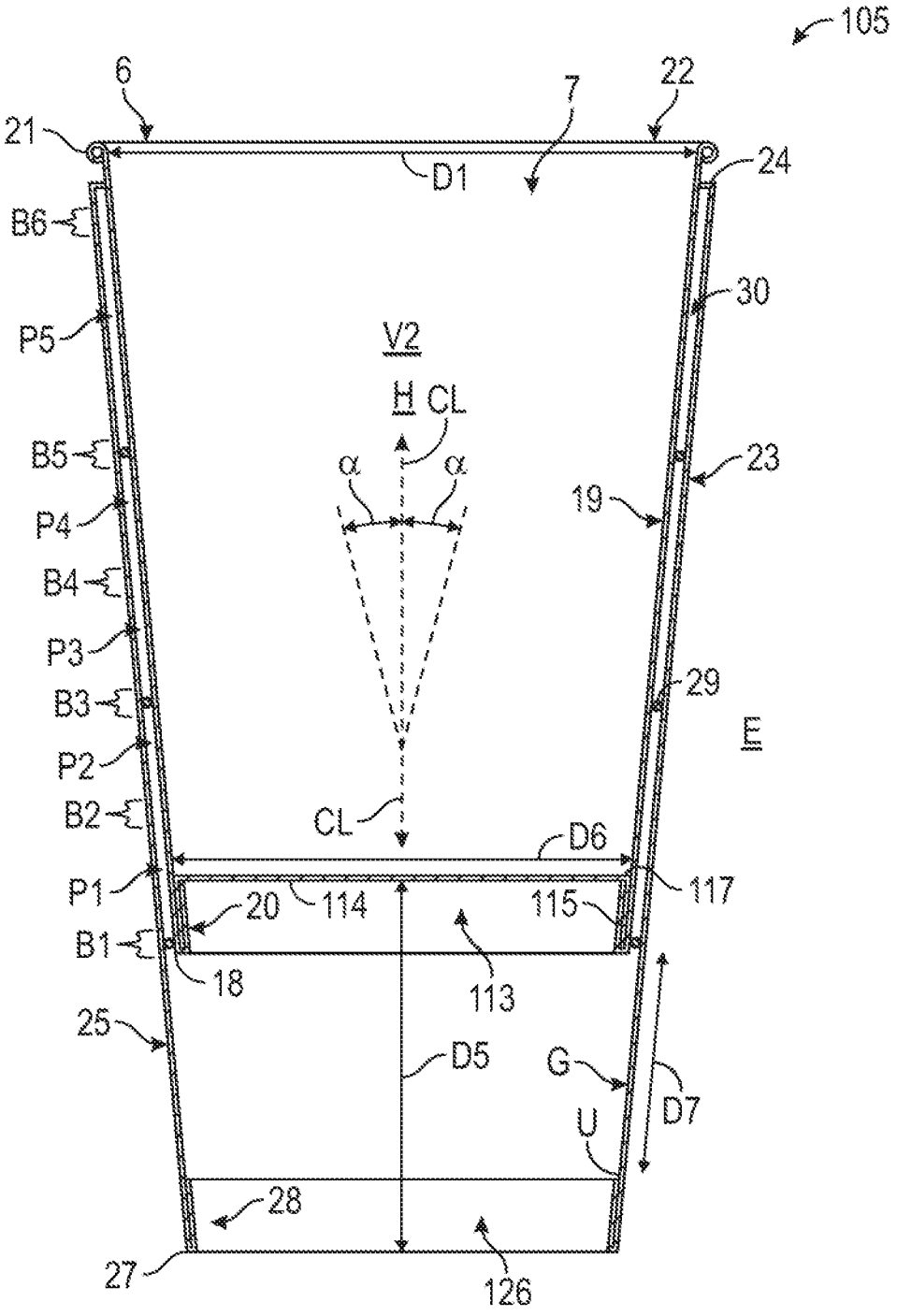
FIG. 5 is a cross-sectional view of a container according to a second exemplary embodiment of the disclosure.

Referring to FIG. 5, a cross-sectional view of a container 105 formed from the sidewall construct 8 is illustrated according to a second exemplary embodiment of the disclosure. It will be understood that the container 105 can be a modification of the container 5 of the first exemplary embodiment of the disclosure. The container 105 includes one or more features that are substantially similar to the container 5 (FIG. 1) of the first exemplary embodiment of the disclosure, and like or similar features are designated with like or similar reference numbers.

As shown, the container 105 is formed by coupling a closed bottom 113 to the inner sidewall 19. The bottom 113 includes a bottom panel 114 and an annular leg 115 foldably connected to the bottom panel 114 and downwardly-depending therefrom. The bottom panel 114 of the closed bottom 113 is disposed a vertical distance D5 (broadly, "second vertical distance") above the lower edge 27 of the container 105. The vertical distance D5 is greater than the vertical distance D3 (FIG. 2) of the first exemplary embodiment such that an interior volume V2 (broadly, "second interior volume") of the interior space 107 of the container 105 is smaller or less than than the interior volume V1 of the interior space 7 of the first exemplary embodiment. In one embodiment, the volume V2 can be about 4 oz, about 6 oz, about 8 oz, about 12 oz, about 16 oz, about 20 oz, or other integer or non-integer numbers therebetween. The container 105 can be provided with a different interior volume without departing from the disclosure.

Such an arrangement is provided by coupling the closed bottom 113 at a greater vertical distance along the inner sidewall 19 than the bottom 13 of the first exemplary embodiment. Since opposing portions of the sidewall construct 8 are spaced further apart at higher vertical locations along the sidewall construct 8, the bottom panel 114 is selected with a diameter D6 that is greater than the diameter D1 of the bottom panel 14 (FIG. 2) of the first exemplary embodiment, with the annular leg 115 and the line of weakening 117 configured accordingly.

In the illustrated arrangement, the lower edge margin 20 of the inner sidewall 19 may be trimmed or otherwise truncated such that the lower edge margin 20 wraps around a bottom edge of the annular leg 115 and into at least partial face-to-face contact with the interior surface of the annular leg 115. In another embodiment, the lower edge margin 20 of the inner sidewall 19 can be positioned to additionally extend along the bottom surface of the bottom panel 114. As also shown, the interior annular recess 126 of the base 25 of the container 105 is larger than the interior annular recess 26 of the container 5 (FIG. 2) of the first exemplary embodiment, with the gap G having a vertical distance D7 along the sidewall construct 8 between the lower edge 18 of the inner sidewall 19 and an upper edge U of the lower edge margin 28 of the sleeve 23, with the distance D7 being greater than the distance D4 of the gap G of the container 5 of the first exemplary embodiment (FIG. 2). In this regard, the size of the gap G can correspond to the vertical position of the closed bottom 113 along the sidewall construct 8.

As additionally shown, the lower edge margin 28 of the sleeve 23 is interiorly folded into face-to-face contact with a lower portion of the outer sleeve 23/annular base 25 to define the lower edge 27 of the container 105 and to provide a two-ply structure at a bottom portion of the annular base 25 as described above with respect to the container 5 (FIG. 2). In one embodiment, the lower edge margin 28 can be positioned to extend along a greater distance of the interior surface of the sleeve 23 such that the upper edge U of the lower edge margin 28 is positioned at a higher vertical location along the sleeve 23 than described above, for example, to adjust the size of the gap G.

While the containers 5, 105 have been illustrated and described herein as two possible configurations of containers formed from the sidewall construct 8, it will be understood that a bottom structure can be positioned at any desired vertical location of the sidewall construct 8 to provide an interior volume corresponding to a desired fluid size for the container. In this regard, at least the configuration and/or location of the bottom of containers formed from the sidewall construct 8 allows for the interior volume of the containers to be selected by a user so as to provide the sidewall construct 8 and containers formed therefrom with scalable features.

The aforementioned configuration of the sidewall construct 8 streamlines manufacturing efforts as at least differently-configured outer sleeves 23 are not required for containers of different fluid sizes produced from the sidewall construct 8, e.g., such that no retooling of forming equipment for the outer sleeve 23 is required. In this regard, visual indicia such as printing or other graphics on the outer surface of the sidewall construct 8 can remain constant across containers of different fluid sizes produced from the sidewall construct 8. In addition, the bottom portions of the respective inner sidewalls 19 can be truncated or otherwise readily adjusted to produce a sidewall construct 8 with a desired interior volume. Further, since the tapered configuration of the sidewall construct 8, e.g., extending at the same angle $\alpha$ relative to the vertical centerline CL, is constant across containers of different fluid sizes produced from the sidewall construct 8, the sidewall construct 8 can be selected with a taper that allows for stacking or nesting of multiple containers 5 corresponding to different fluid sizes.

Figure 6A:
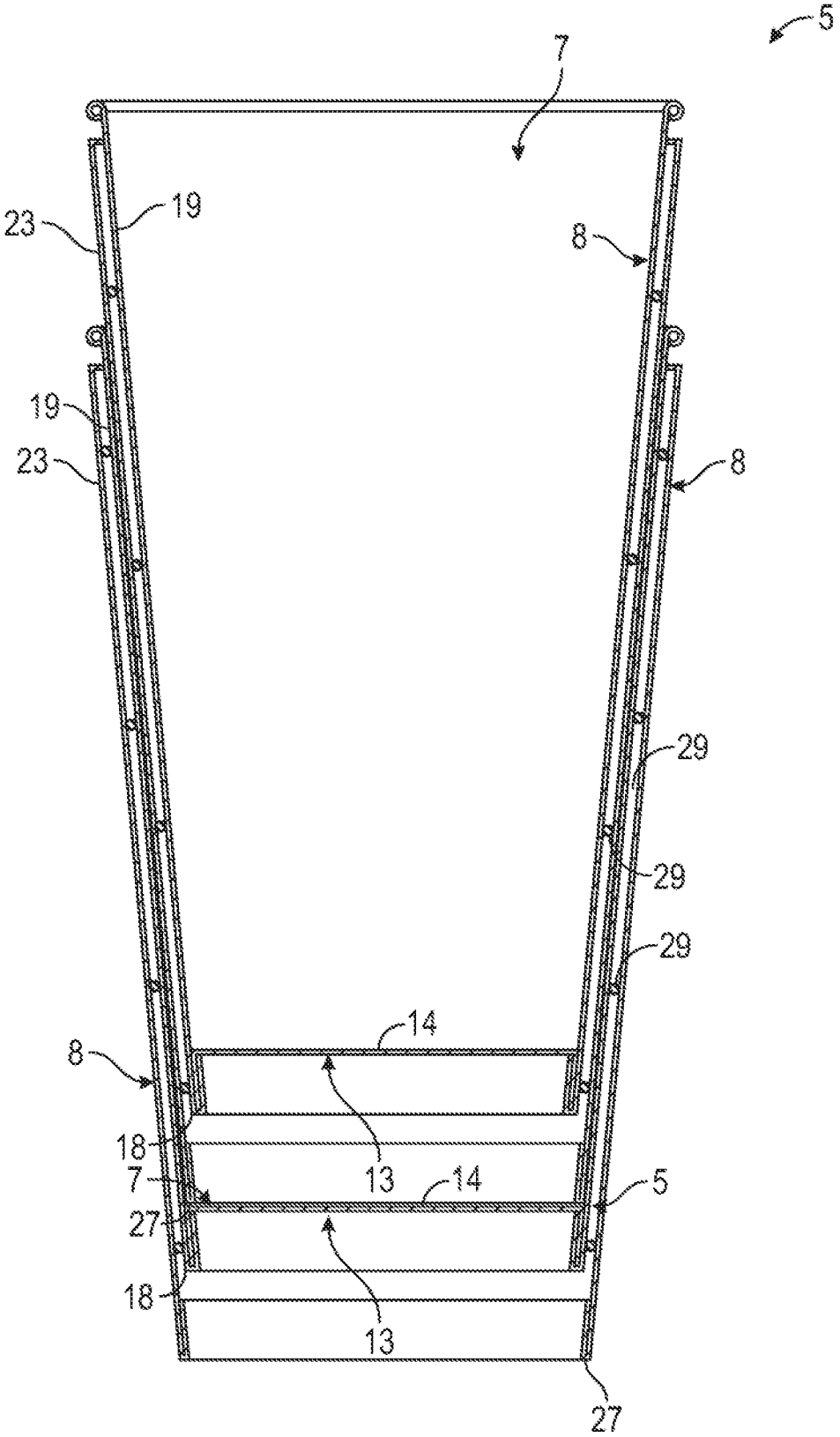
FIG. 6A is a cross-sectional view of a pair of containers, each as shown in FIG. 2, in a nested arrangement.
Figure 6B:
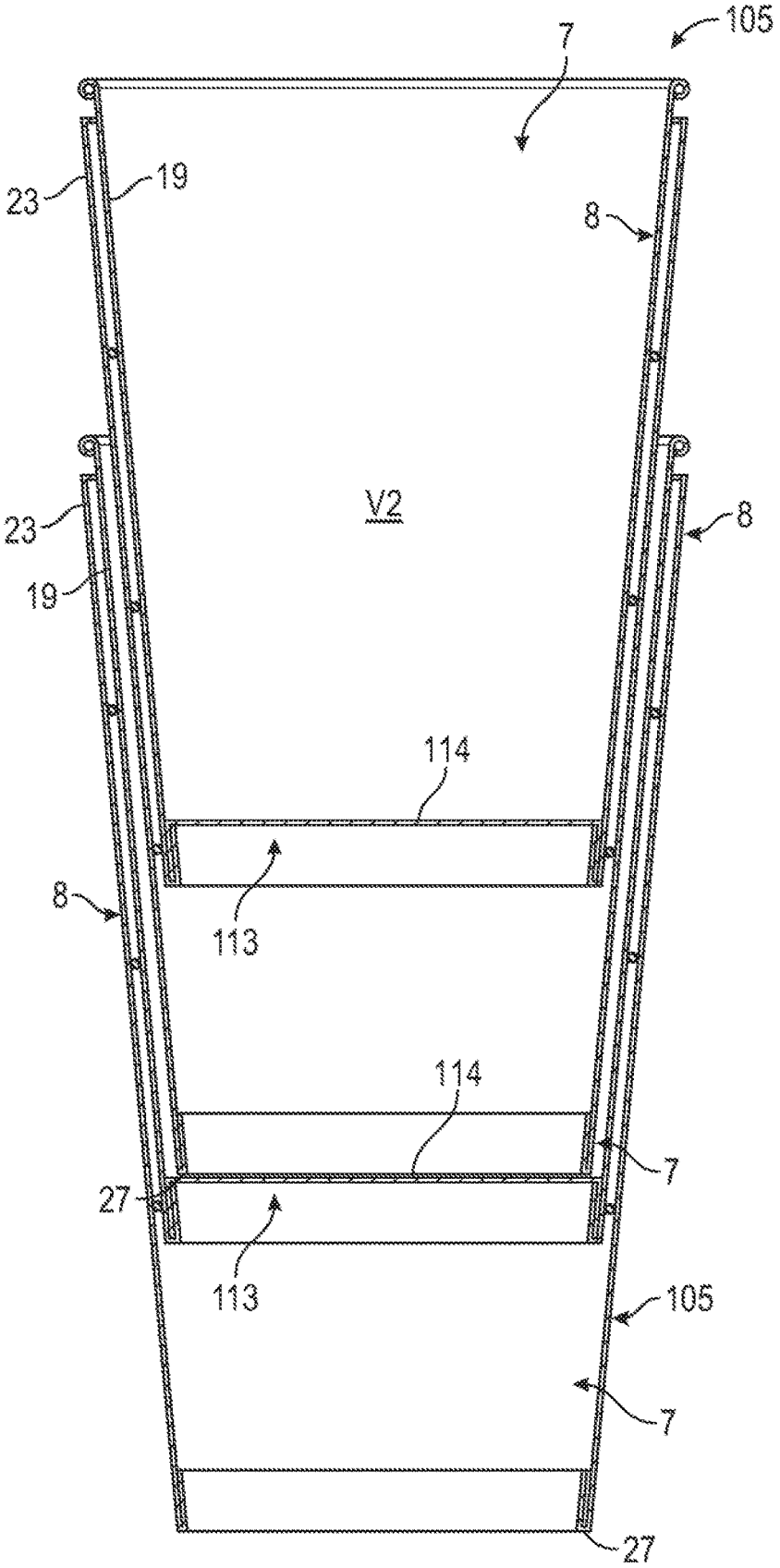
FIG. 6B is a cross-sectional view of a pair of containers, each as shown in FIG. 5, in a nested arrangement.

For example, and with additional reference to FIGS. 6A, 6B, the angle $\alpha$ of the sidewall construct 8 can be selected such that the lower edge 27 of a respective upper container 5, 105 engages the respective bottom panel 14, 114 of a respective lower receiving container 5, 105 prior to substantial frictional engagement of the sidewall constructs 8 of the respective containers 5, 105 e.g., so that respective containers 5, 105 can be easily separated or otherwise de-nested from one another. In one embodiment, the container 5 can include surface features to facilitate separation or de-nesting, for example, embossed and/or embossed surfaces. Such an arrangement also allows for containers of different fluid sizes produced from the sidewall construct 8 to be stacked or nested with one another, without the need to separately stack or nest containers of different fluid sizes. Further still, since the rims 21 of containers of different fluid sizes produced from the sidewall construct 8 construct are uniform, lids or other top closure structures of a uniform configuration can be produced for the containers of different fluid sizes.

The containers and/or the blanks that form the containers according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the container to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

The above embodiments may be described as having one or more portions adhered together by glue during erection of the container embodiments. The term "glue" is intended to encompass all manner of adhesives commonly used to secure containers in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A container for containing a fluid, comprising:

a sidewall construct comprising an inner sidewall extending at least partially around an interior of the container and having an inner lower edge, and an outer sleeve attached to the inner sidewall, the outer sleeve has an outer lower edge that is spaced below the inner lower edge; and a closed bottom defining a bottom of the interior of the container, the closed bottom is selectively positioned at a first vertical distance from the outer lower edge or at a second vertical distance from the outer lower edge, the container has a first interior volume when the closed bottom is at the first vertical distance and the container has a second interior volume when the closed bottom is at the second vertical distance, the first vertical distance is less than the second vertical distance such that the first interior volume is greater than the second interior volume.

2. The container of claim 1, wherein the closed bottom is selectively positioned at the first vertical distance from the outer lower edge or at the second vertical distance from the outer lower edge such that an interior volume of the container is scalable based on the selected position of the closed bottom.

3. The container of claim 2, wherein the sidewall construct is oriented at a fixed angle relative to a vertical centerline of the container when the closed bottom is positioned at the first vertical distance and at the second vertical distance.

4. The container of claim 2, wherein the closed bottom is spaced above the outer lower edge such that a lower portion of the outer sleeve defines an annular recess below the closed bottom.

5. The container of claim 4, wherein the closed bottom comprises a bottom panel and an annular leg extending downwardly from the bottom panel and attached to the inner sidewall, the annular leg is spaced above the outer lower edge.

6. The container of claim 5, wherein a portion of the outer sleeve defines a lower edge margin that is folded into the annular recess and into at least partial face-to-face contact with the lower portion of the outer sleeve.

7. The container of claim 6, wherein the inner lower edge is spaced above an upper edge of the lower edge margin of the outer sleeve such that a gap is defined therebetween.

8. A container for containing a fluid, comprising: a sidewall construct comprising an inner sidewall extending at least partially around an interior of the container and having an inner lower edge, and an outer sleeve attached to the inner sidewall, the outer sleeve has an outer lower edge that is spaced below the inner lower edge; and a closed bottom defining a bottom of the interior of the container, the closed bottom is positioned a selected vertical distance from the outer lower edge such that an interior volume of the container is scalable based on a position of the closed bottom, the closed bottom is spaced above the outer lower edge such that a lower portion of the outer sleeve defines an annular recess below the closed bottom, the closed bottom comprises a bottom panel and an annular leg extending downwardly from the bottom panel and attached to the inner sidewall, the annular leg is spaced above the outer lower edge and a portion of the outer sleeve defines a lower edge margin that is folded into the annular recess and into at least partial face-to-face contact with the lower portion of the outer sleeve, the inner lower edge is spaced above an upper edge of the lower edge margin of the outer sleeve such that a gap is defined therebetween, wherein a cavity is defined between the inner sidewall and the outer sleeve, and the gap provides a vent for the cavity.

9. The container of claim 2, wherein a cavity is defined between the inner sidewall and the outer sleeve, and the container comprises insulating features comprising the cavity and a plurality of annular bands, each annular band of the plurality of annular bands comprises a plurality of spacers and a respective plurality of gaps separating respective adjacent spacers in a respective annular band, each spacer extends in the cavity from the inner sidewall to the outer sleeve.

10. The container of claim 9, wherein the respective gaps of the respective annular bands define a plurality of fluid paths through the cavity.

11. The container of claim 10, wherein the respective gaps of respective adjacent annular bands are offset from one another.

12. The container of claim 11, wherein at least one fluid path of the plurality of fluid paths extends from the inner lower edge to an upper edge of the outer sleeve.

13. The container of claim 9, wherein at least one spacer is comprised of an adhesive that adheres the outer sleeve to the inner sidewall.

14. The container of claim 2, wherein an upper portion of the inner sidewall defines a flanged rim, the rim is configured to interengage a container closure.

15. A method of forming a container for containing a fluid, comprising;

obtaining an inner sidewall having an inner lower edge and an outer sleeve having an outer lower edge;

attaching the outer sleeve to the inner sidewall to form a sidewall construct having the outer lower edge spaced below the inner lower edge;

forming an interior of the container by positioning the sidewall construct so that the inner sidewall extends at least partially around the interior; and selectively positioning a closed bottom relative to the sidewall construct to define a bottom of the interior such that the closed bottom is selectively positioned at a first vertical distance from the outer lower edge or at a second vertical distance from the outer lower edge, the container has a first interior volume when the closed bottom is at the first vertical distance and the container has a second interior volume when the closed bottom is at the second vertical distance, the first vertical distance is less than the second vertical distance such that the first interior volume is greater than the second interior volume.

16. The method of claim 15, wherein the closed bottom is selectively positioned at the first vertical distance from the outer lower edge or the second vertical distance from the outer lower edge such that an interior volume of the container is scalable based on the selected position of the closed bottom.

17. The method of claim 16, wherein the sidewall construct is oriented at a fixed angle relative to a vertical centerline of the container when the closed bottom is positioned at the first vertical distance and at the second vertical distance.

18. The method of claim 16, wherein the closed bottom is spaced above the outer lower edge such that a lower portion of the outer sleeve defines an annular recess below the closed bottom.

19. The method of claim 18, wherein the closed bottom comprises a bottom panel and an annular leg extending downwardly from the bottom panel and attached to the inner sidewall, the annular leg is spaced above the outer lower edge.

20. The method of claim 19, wherein a portion of the outer sleeve defines a lower edge margin that is folded into the annular recess and into at least partial face-to-face contact with the lower portion of the outer sleeve.

21. The method of claim 20, wherein the inner lower edge is spaced above an upper edge of the lower edge margin of the outer sleeve such that a gap is defined therebetween.

22. The method of claim 21, wherein a cavity is defined between the inner sidewall and the outer sleeve, and the gap provides a vent for the cavity.

23. The method of claim 16, wherein a cavity is defined between the inner sidewall and the outer sleeve, and the container comprises insulating features comprising the cavity and a plurality of annular bands, each annular band of the plurality of annular bands comprises a plurality of spacers and a respective plurality of gaps separating respective adjacent spacers in a respective annular band, each spacer extends in the cavity from the inner sidewall to the outer sleeve.

24. The method of claim 23, wherein the respective gaps of the respective annular bands define a plurality of fluid paths through the cavity.

25. The method of claim 24, wherein the respective gaps of respective adjacent bands are offset from one another.

26. The method of claim 25, wherein at least one fluid path of the plurality of fluid paths extends from the inner lower edge to an upper edge of the outer sleeve.

27. The method of claim 23, wherein at least one spacer is comprised of an adhesive that adheres the outer sleeve to the inner sidewall.

28. The method of claim 16, wherein an upper portion of the inner sidewall defines a flanged rim, the rim is configured to interengage a container closure.

29. A container for containing a fluid, comprising:

a sidewall construct comprising an inner sidewall extending at least partially around an interior of the container and having an inner lower edge, and an outer sleeve attached to the inner sidewall, the outer sleeve has an outer lower edge that is spaced below the inner lower edge; and a closed bottom defining a bottom of the interior of the container, the closed bottom is spaced above the outer lower edge such that a lower portion of the outer sleeve defines an annular recess below the closed bottom, a portion of the outer sleeve defines a lower edge margin that is folded into the annular recess and into at least partial face-to-face contact with the lower portion of the outer sleeve, the inner lower edge is spaced above an upper edge of the lower edge margin of the outer sleeve such that a gap is defined therebetween.

30. The container of claim 29, wherein a cavity is defined between the inner sidewall and the outer sleeve, and the gap provides a vent for the cavity.

* * * * *